US006401735B1

(12) United States Patent
Chou

(10) Patent No.: US 6,401,735 B1
(45) Date of Patent: Jun. 11, 2002

(54) STRETCHING STRUCTURE FOR SUNSHADE BODY

(75) Inventor: Shan Chung Chou, Hor-Me Changhua (TW)

(73) Assignee: Tong Yih Plastic Co., Ltd. (TW)

( * ) Notice: Subject to any disclaimer, the term of this patent is extended or adjusted under 35 U.S.C. 154(b) by 0 days.

(21) Appl. No.: 09/630,370

(22) Filed: Aug. 1, 2000

(51) Int. Cl.[7] ..... A45B 11/00

(52) U.S. Cl. ..... 135/20.1; 135/20.3; 135/21; 135/90; 135/98

(58) Field of Search ..... 135/90, 98, 20.1, 135/25.1, 21, 29, 31, 32

(56) References Cited

U.S. PATENT DOCUMENTS 4,586,525 A * 5/1986 Glatz ..... 135/20.1
5,116,258 A * 5/1992 Vennik ..... 135/20.2
5,263,505 A * 11/1993 Yeom ..... 135/20.1
5,785,069 A * 7/1998 Glatz ..... 135/20.1
5,927,310 A * 7/1999 Lin ..... 135/20.1
5,937,882 A * 8/1999 Harbaugh ..... 135/20.3
5,960,806 A * 10/1999 Steiner ..... 135/20.1
6,196,242 B1 * 3/2001 Xu ..... 135/20.1

* cited by examiner

*Primary Examiner*—Beth A. Stephan
(74) *Attorney, Agent, or Firm*—Bacon & Thomas, PLLC

(57) ABSTRACT

A stretching structure for sunshade body. The structure includes a stem, an auxiliary lever, a push lever, an upper beehive, a lower beehive, several upper support ribs, several lower support ribs, several cock members, several pivot blocks, several arch fitting blocks, several L-shaped fitting blocks and two metal cords. When stretching the sunshade body, a locating collar fitted on the stem is upwardly pushed or downwardly pulled and located by a locating handle. At this time, the upper support rib pivotally connected with the locating collar drives the auxiliary lever which drives the push lever and the lower support rib so as to upwardly and outwardly stretch open the upper and lower support ribs.

1 Claim, 5 Drawing Sheets

STRETCHING STRUCTURE FOR SUNSHADE BODY

BACKGROUND OF THE INVENTION

The present invention relates to a stretching structure for sunshade body, by which the sunshade body can be easily and quickly stretched open or collected only by means of upward pushing or downward pulling a locating collar fitted on the stem. Moreover, no cord is used for stretching open the sunshade body so that the problem of breakage of the cord is eliminated and the stretching structure can be more durably used. The structure has less components which can be easily assembled so that the manufacturing cost is lowered.

FIG. 1 shows a stretching structure of a conventional sunshade. A pivot member 151 is fixed at lower section of the stem 11 of the sunshade body 10. The pivot member 151 is pivotally connected with one end of an auxiliary lever 16. A roller 14 is disposed in the pivot member 151. The other end of the auxiliary lever 16 is pivotally connected to upper side of a middle section of an upper support rib 18. Another roller 14 is disposed at the pivot section. One of each of several upper support ribs 18 is pivotally connected with an upper beehive 171 of the main rib 17. A cock member 181 is plugged in the other end of the upper support rib 18. The lower side of the middle section of the upper support rib 18 is pivotally connected with one end of a lower support rib 182. The other end of the lower support rib 182 is pivotally connected with the lower beehive 172. One end of the cord A is upward conducted from the winding device 12 to wind over the respective rollers 14 and pass through the upper beehive 171 and the main rib 17 and then extend out of the lower beehive 172. The end of the cord A is then knotted and fixed. When turning the winding crank 121 of the winding device 12 to wind the cord A, the cord A drives the lower beehive 172 upward to drive the lower support ribs 182 and the upper support ribs 18. Therefore, the upper and lower support ribs 18, 182 are upward stretched open. Then a locating handle 132 of a locating collar 13 is shifted downward to make an eccentric wheel fasten and locate the cord A. At this time, the sunshade body 10 is stretched open. When collected, the above operation is reversely performed.

The above conventional stretching structure has some shortcomings as follows:

1. The sunshade body 10 is stretched or collected by means of the winding device 12, three rollers 14 and a cord A. Such structure includes numerous components so that the manufacturing cost is relatively high.
2. It is troublesome and time-consuming to assemble the numerous components.
3. After a long period of use, the cord A tends to break due to over-abrasion. This will make it impossible to stretch open the sunshade body 10. Therefore, the conventional sunshade cannot be durably used.

SUMMARY OF THE INVENTION

It is therefore a primary object of the present invention to provide a stretching structure for sunshade body, which has less components so that the manufacturing cost is lowered.

It is a further object of the present invention to provide the above stretching structure for sunshade body in which the components can be easily assembled so that the assembling time and labor are reduced.

It is still a further object of the present invention to provide the above stretching structure for sunshade body, by which the sunshade body can be easily and quickly stretched open or collected only by means of upward pushing downward pulling a locating collar fitted on the stem. Moreover, no cord is used for stretching open the sunshade body so that the problem of breakage of the cord is eliminated and the stretching structure can be more durably used.

The present invention can be best understood through the following description and accompanying drawings wherein:

DETAILED DESCRIPTION OF THE PREFERRED EMBODIMENT

Figure 1:
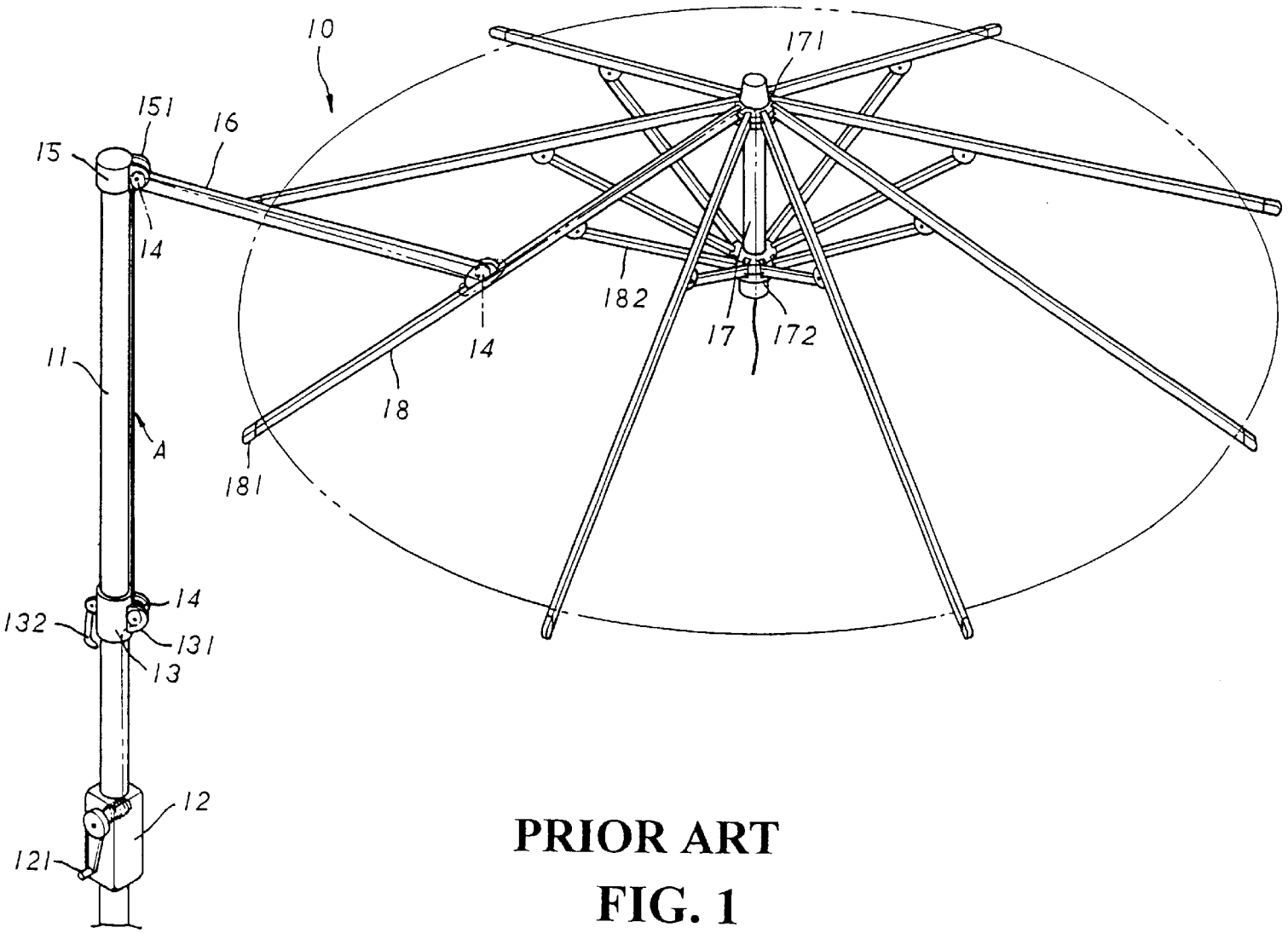
PRIOR ART FIG. 1
FIG. 1 is a perspective view of a conventional stretching structure for sunshade body.
Figure 2:
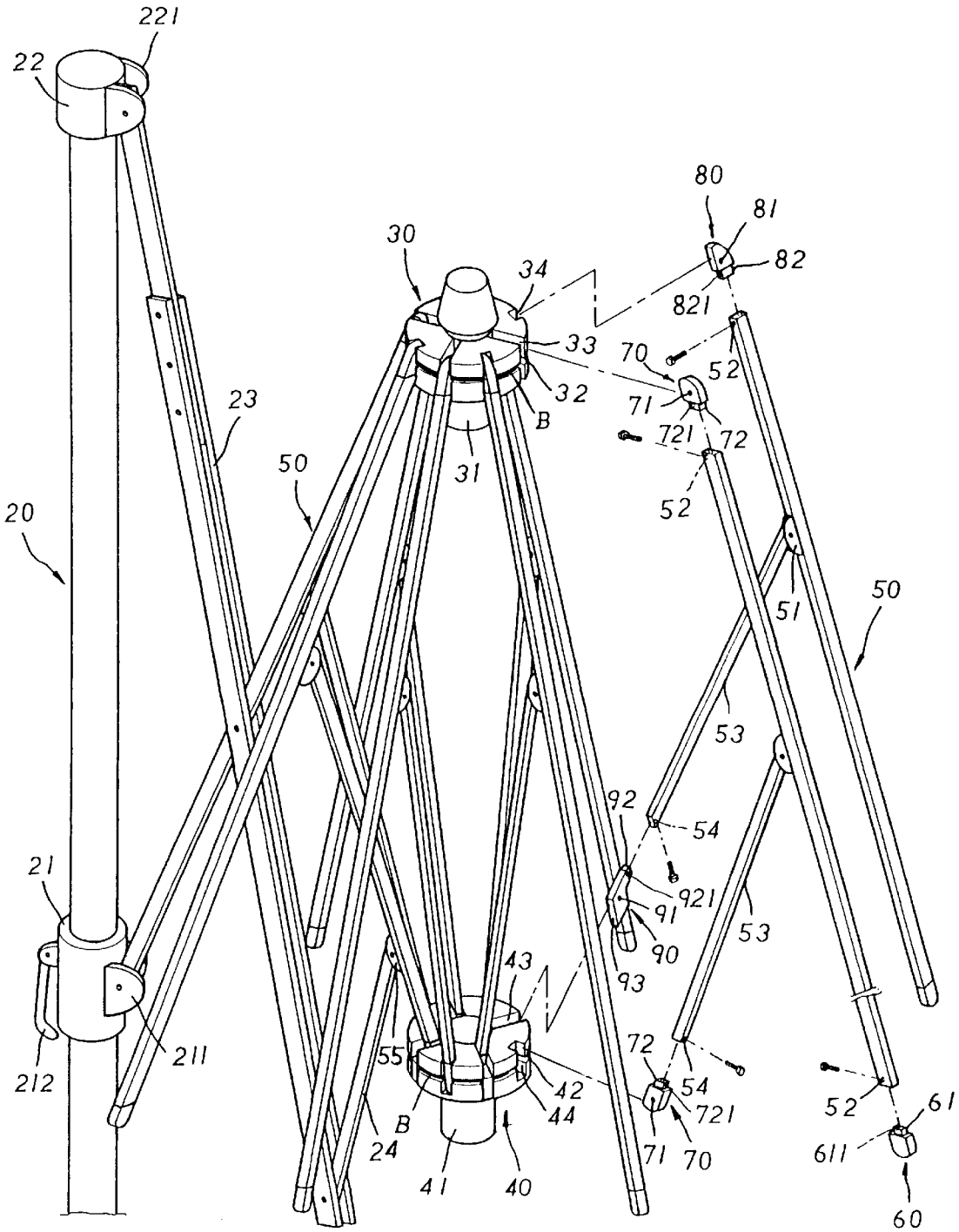
FIG. 2 is a perspective exploded view of the present invention.

Please refer to FIG. 2. The present invention includes a stem 20, an auxiliary lever 23, a push lever 24, an upper beehive 30, a lower beehive 40, eight upper support ribs 50, eight lower support ribs 53, seven cock members 60, four pivot blocks 70, four arch fitting blocks 80, eight L-shaped fitting blocks 90 and two metal cords B. A locating collar 21 is fitted on the stem 20. A pivot member 211 is disposed on one side of the locating collar 21 and pivotally connected with one end of one upper support rib 50. A locating handle 212 having an eccentric wheel is disposed on the other side of the locating collar 21. A pivot section 22 is fixed at the top end of the stem 20. A pivot member 221 is disposed on one side of the pivot section 22 and pivotally connected with one end of the auxiliary lever 23. The other end of the auxiliary lever 23 is pivotally connected with the push lever 24. A middle section of the auxiliary lever 23 is pivotally connected with a middle section of the upper support rib 50 connected with the pivot member 211 of the locating collar 21 in a cross-like pattern. The upper beehive 30 is a hoop body the center of which is fixed with an upper main rib 31. A middle portion of the circumference of the upper beehive 30 is formed with an annular groove 32. Four long splits 33 with a certain depth are formed on the circumference of the upper beehive 30 at equal intervals. A short split 34 is formed between each two adjacent long splits 33. The lower beehive 40 is a hoop body. The lower side of the center of the lower beehive 40 is fixed with a lower main rib 41. A middle portion of the circumference of the lower beehive 40 is formed with an annular groove 42. Four long splits 43 with a certain depth are formed on the circumference of the lower beehive 40 at equal intervals. A short split 44 is formed between each two adjacent long splits 43. The upper support rib 50 is a longer and hollow rectangular rib. A pivot member 51 is disposed on lower side of middle section of the upper support rib 50 and pivotally connected with one end of the lower support rib 53. Each end section of the upper support rib 50 is formed with a circular hole 52 on the short side. The lower support rib 53 is a shorter and hollow rectangular rib. One end of the lower support rib 53 is formed with a circular hole 54 on the short side. A pivot member 55 is disposed on outer side of lower section of one lower support rib 53 and pivotally connected with the other end of the push lever 24. The cock body 60 is a semielliptic body. A rectangular block 61 is disposed on a plane face of the cock body 60. The rectangular block 61 extends forward by a certain length and is slightly smaller than the inner diameter of the upper support rib 50. The short side of the rectangular block 61 is formed with a circular hole 611 with a certain depth. The pivot block 70 is a semielliptic body and formed with a central through hole 71. A rectangular block 72 is disposed on a plane face of the pivot block 70. The rectangular block 72 extends forward and is slightly smaller than the inner diameter of the upper and lower support ribs 50, 53. The short side of tile rectangular block 72 is formed with a circular hole 721 with a certain depth. The arch fitting block 80 is a quarter-cylindrical body. The corner of the arch fitting block 80 is formed with a through hole 81. A rectangular block 82 is disposed on a bottom face of the arch fitting block 80. The rectangular block 82 extends forward and is slightly smaller than the inner diameter of the upper support rib 50. The short side of the rectangular block 82 is formed with a circular hole 821 with a certain depth. The L-shaped fitting block 90 is an L-shaped member. The outer corner of the L-shaped fitting block 90 is formed with a through hole 91. A rectangular block 92 is disposed at top end of the L-shaped fitting block 90. The rectangular block 92 extends forward and is slightly smaller than the inner diameter of the lower support rib 53. The short side of the rectangular block 92 is formed with a circular hole 921 with a certain depth. The bottom face of the L-shaped fitting block 90 is a slope face 93. One side of the inner corner is also a slope face.

Figure 3:
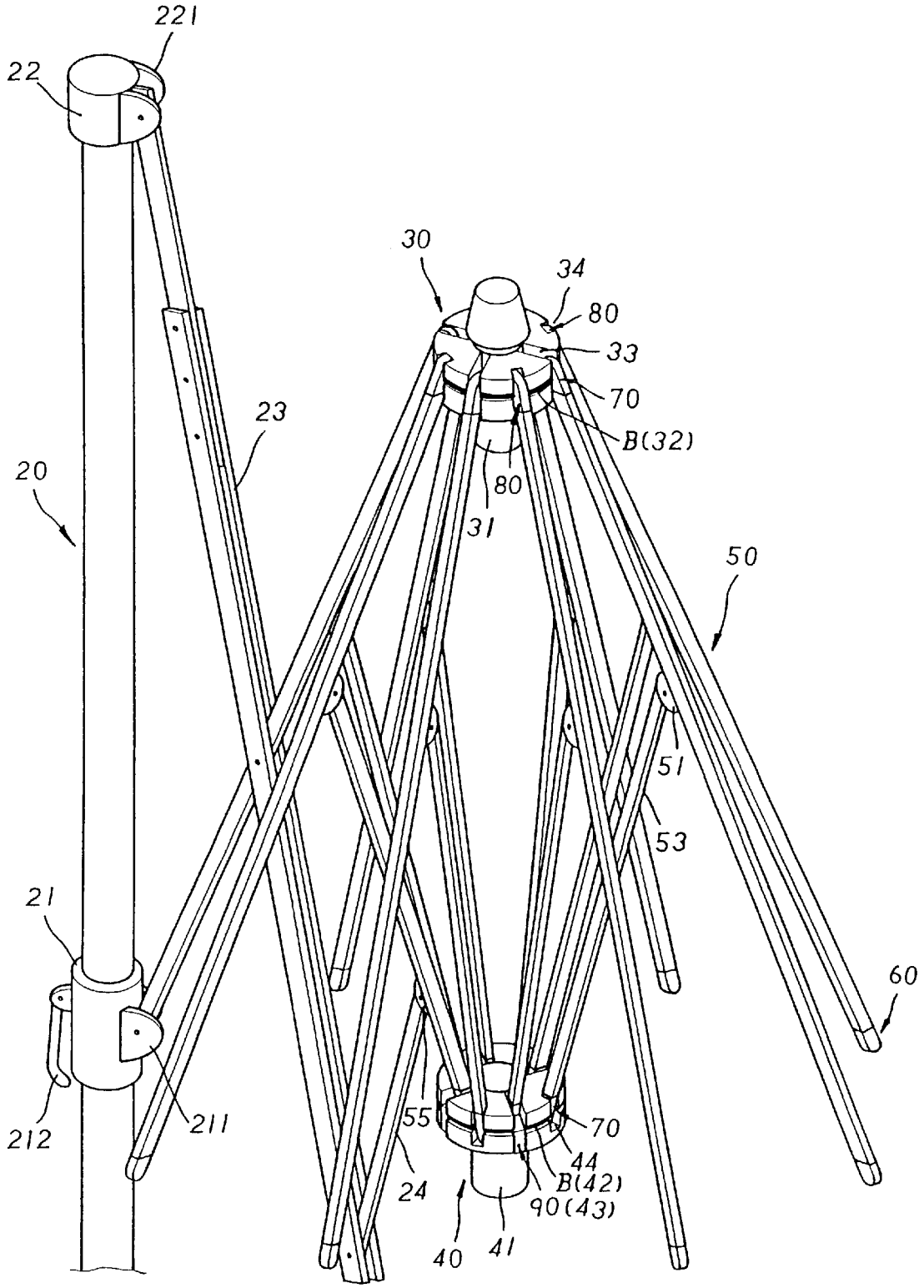
FIG. 3 is a perspective assembled view of the present invention.
Figure 5A:
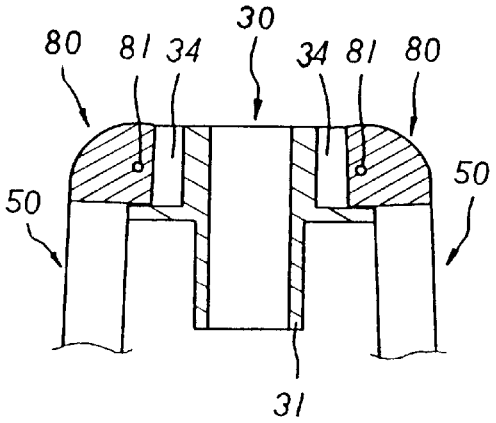
FIGS. 5A and 5B are sectional view of a part of the structure of FIG. 3.
Figure 5B:
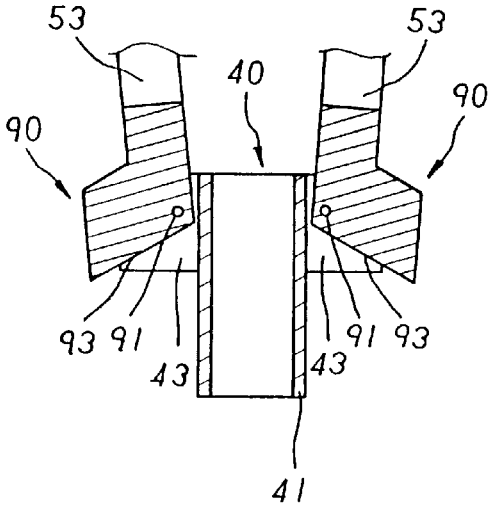

Referring to FIGS. 3 and 5, when assembled, the rectangular blocks 61 of the seven cock bodies 60 are respectively plugged into lower ends of the upper support ribs 50. Screws are respectively passed through the circular holes 52 of the upper support ribs 50 and locked at the circular holes 611 of the cock bodies 60. Then, the rectangular blocks 72 of the eight pivot blocks 70 are respectively plugged into the other ends of the four upper support ribs 50 and four lower support ribs 53. Screws are respectively passed through the circular holes 52, 54 of the upper support ribs 50 and lower support ribs 53 and locked at the circular holes 721 of the pivot blocks 70. The rectangular blocks 82 of the four arch fitting blocks 80 are respectively plugged into the other ends of the four upper support ribs 50. The rectangular blocks 92 of the four L-shaped fitting blocks 90 are respectively plugged into the other ends of four lower support ribs 53. Screws are respectively passed through the circular holes 52 of the upper support ribs 50 and locked at the circular holes 821 of the arch fitting blocks 80 and passed through the circular holes 52 of the upper support ribs 50 and locked at the circular holes 921 of the L-shaped fitting blocks 90. Then the four pivot blocks 70 fixed at the ends of the upper support ribs 50 are received in the long splits 33 of the upper beehive 30 and the four arch fitting blocks 80 are received in the short splits 34. A metal cord B is passed through the through holes 71 of the four pivot blocks 70 and the through holes 81 of the four arch fitting blocks 80 and fixed in the annular groove 32 of the upper beehive 30. Finally, the four pivot blocks 70 fixed at the ends of the lower support ribs 53 are received in the short splits 44 of the lower beehive 40 and the four L-shaped fitting blocks 90 are received in the long splits 43. Another metal cord B is passed through the through holes 71 of the four pivot blocks 70 and the through holes 91 of the four L-shaped fitting blocks 90 and fixed in the annular groove 42 of the lower beehive 40 to complete the assembly.

Figure 4:
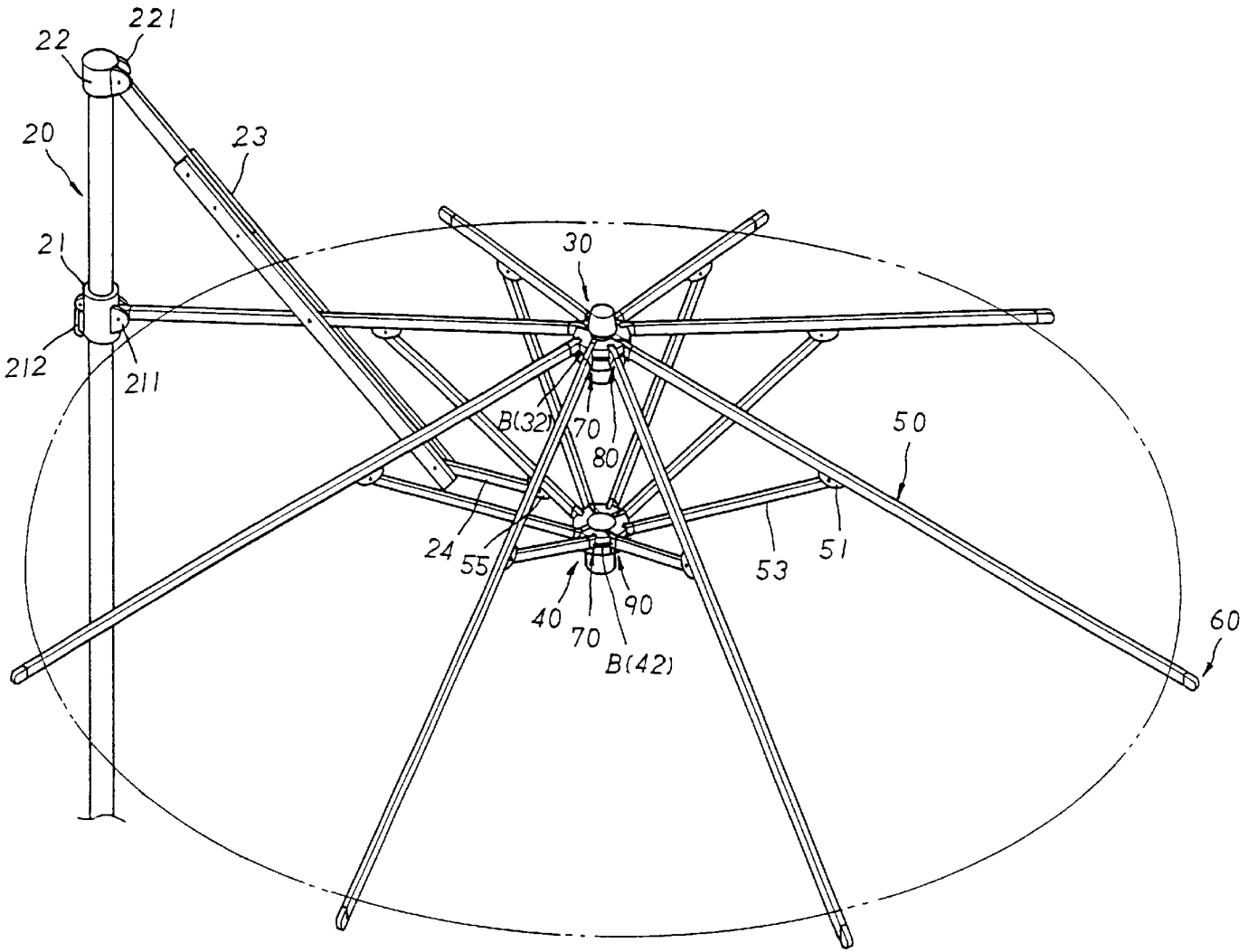
FIG. 4 is a perspective view showing the stretching operation of the sunshade body of the present invention.
Figure 6A:
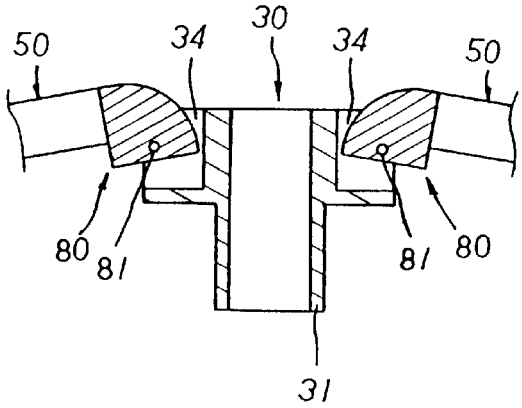
FIGS. 6A and 6B are sectional view of a part of the structure of FIG. 4.
Figure 6B:
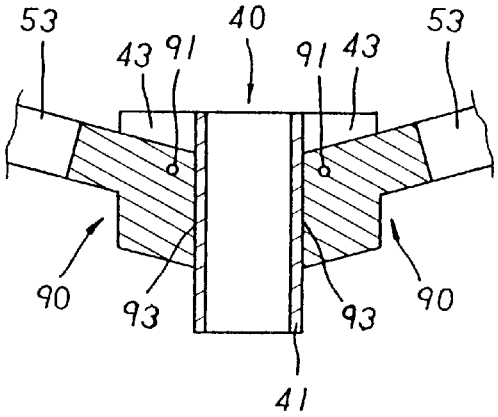

Referring to FIGS. 4 and 6, when stretching open the sunshade body, the locating collar 21 of the stem 20 is upward pushed. At this time, the upper support rib 50 pivotally connected with the locating collar 21 will drive the auxiliary lever 23 which drives the push lever 24 and the lower support rib 53 so as to upward and outward stretch open the upper and lower support ribs 50, 53. At this time, the four pivot blocks 70 pivotally connected with the upper beehive 30 will upward smoothly stretch open the other upper support ribs 50. The arch angle of the arch fitting block 80 will abut against the inner surface of the short split 34 of the upper beehive 30. Also, the four pivot blocks 70 pivotally connected with the lower beehive 40 will upward smoothly stretch open the other lower support ribs 53. The bottom slope face 93 of the L-shaped fitting block 90 will abut against the inner surface of the long split 43 of the lower beehive 40. Then the locating handle 212 of the locating collar 21 is downward shifted to make the eccentric wheel fasten and locate the locating collar 21. Therefore, the sunshade body is stretched open at a fixed position. When collected, the locating handle 212 of the locating collar 21 is upward shifted to make the eccentric wheel release the locating collar 21. At this time, the locating collar 21 can be pulled downward to collect the sunshade body.

According to the above arrangement, the present invention has the following advantages:

1. The structure has less components so that the manufacturing cost is lowered.
2. The components can be easily assembled so that the assembling time and labor are reduced.
3. The sunshade body can be easily and quickly stretched open or collected only by means of upward pushing or downward pulling the locating collar fitted on the stem. Moreover, no cord is used for stretching open the sunshade body so that the problem of breakage of the cord is eliminated and the stretching structure can be more durably used.

The above embodiment is only used to illustrate the present invention, not intended to limit the scope thereof. Many modifications of the above embodiment can be made without departing from the spirit of the present invention.

What is claimed is:

1. A stretching structure for a sunshade body, comprising a stem, an auxiliary lever, a push lever, an upper beehive, a lower beehive, a plurality of upper support ribs, a plurality of lower support ribs, a plurality of cock members, a plurality of pivot blocks, a plurality of arch fitting blocks, a plurality of L-shaped fitting blocks and two metal cords, a locating collar being fitted on the stem, a pivot member being disposed on one side of the locating collar, a locating handle having an eccentric wheel being disposed on the other side of the locating collar, a pivot section being fixed at a top end of the stem, a pivot member being disposed on one side of the pivot section, the upper beehive being a hoop body the center of which is fixed with an upper main rib, a middle portion of the circumference of the upper beehive being formed with an annular groove, a plurality of long splits with a certain depth being formed on the circumference of the upper beehive at equal intervals, a short spilt being formed between each two adjacent long splits, the lower beehive being a hoop body, a lower side of the center of the lower beehive being fixed with a lower main rib, a middle portion of the circumference of the lower beehive being formed with an annular groove, a plurality of long splits with a certain depth being formed on the circumference of the lower beehive at equal intervals, a short split being formed between each two adjacent long splits, each upper support rib being a hollow rectangular rib, a pivot member being disposed on a lower side of a middle section of one of the upper support ribs and pivotally connected with one end of one of the lower support ribs, each end section of the upper support rib being formed with a circular hole on one of the short sides, the lower support rib being a hollow rectangular rib, one end of the lower support rib being formed with a circular hole on one of the short sides, a pivot member being disposed on an outer side of a lower section of the lower support rib, the cock member being a semielliptic body, a rectangular block being disposed on a plane face of the cock member, the rectangular block is slightly smaller than the inner diameter of the upper support rib, one of the short sides of the rectangular block being formed with a circular hole with a certain depth, the cock member being fixed to one end of the upper support rib by a screw;

the pivot block is a semielliptic body and formed with a central through hole, a rectangular block being disposed on a plane face of the pivot block, the rectangular block is slightly smaller than the inner diameter of the upper and lower support ribs, one of the short sides of the rectangular block being formed with a circular hole with a certain depth;

the arch fitting block is a quarter-cylinder body, a corner of the arch fitting block being formed with a through hole, a rectangular block being disposed on a bottom face of the arch fitting block, the rectangular block is slightly smaller than the inner diameter of the upper support rib, one of the short sides of the rectangular block being formed with a circular hole with a certain depth;

the L-shaped fitting block is an L-shaped member, an outer corner of the L-shaped fitting block being formed with a through hole, a rectangular block being disposed at a top end of the L-shaped fitting block, the rectangular block is slightly smaller than the inner diameter of the lower support rib, one of the short sides of the rectangular block being formed with a circular hole with a certain depth, a bottom face of the L-shaped fitting block being a slope face, one side of an inner corner of the L-shaped fitting block being also a slope face; and the pivot member of the locating collar is pivotally connected with one end of one of the upper support ribs, the pivot member of the stem being pivotally connected with one end of the auxiliary lever, the other end of the auxiliary lever being pivotally connected with one end of the push lever, a middle section of the auxiliary lever being pivotally connected with a middle section of the upper support rib connected with the pivot member of the locating collar in a cross-like pattern, a pivot member located on the lower support rib being pivotally connected with the other end of the push lever, the pivot blocks being respectively fixed on ends of the upper and lower support ribs by screws, the arch fitting blocks being respectively fixed on ends of the upper support ribs by screws, the L-shaped fitting blocks being respectively fixed on ends of the lower support ribs by screws, the pivot blocks fixed at the ends of the upper support ribs being received in the long splits of the upper beehive and the arch fitting blocks being received in the short splits thereof, one of the metal cords being passed through the through holes of the pivot blocks and the arch fitting blocks to fix the pivot blocks and arch fitting blocks on the upper beehive, the pivot blocks fixed at the ends of the lower support ribs being received in the short splits of the lower beehive and the L-shaped fitting blocks being received in the long splits thereof, the other metal cord being passed through the through holes of the pivot blocks and the L-shaped fitting blocks to fix the pivot blocks and the L-shaped fitting blocks on the lower beehive.

* * * * *